US009231344B1

(12) United States Patent
Liao

(10) Patent No.: US 9,231,344 B1
(45) Date of Patent: Jan. 5, 2016

(54) DOUBLE-SIDED USB CONNECTOR STRUCTURE HAVING A SPRING MECHANISM SUPPORTING AN INSULATING BODY WITH PLURALITY OF TERMINALS ON TWO SURFACES OF THE INSULATING BODY

(71) Applicant: Sheng-Hsin Liao, New Taipei (TW)

(72) Inventor: Sheng-Hsin Liao, New Taipei (TW)

( * ) Notice: Subject to any disclaimer, the term of this patent is extended or adjusted under 35 U.S.C. 154(b) by 0 days.

(21) Appl. No.: 14/555,658

(22) Filed: Nov. 27, 2014

(30) Foreign Application Priority Data

Sep. 1, 2014 (TW) ..... 103130117 A

(51) Int. Cl.

| | |
|---|---|
| ***H01R 27/00*** | (2006.01) |
| ***H01R 13/631*** | (2006.01) |
| ***H01R 24/60*** | (2011.01) |
| ***H01R 13/642*** | (2006.01) |
| ***H01R 24/00*** | (2011.01) |
| *H01R 107/00* | (2006.01) |

(52) U.S. Cl.
CPC ..... *H01R 13/6315* (2013.01); *H01R 13/642* (2013.01); *H01R 23/02* (2013.01); *H01R 24/60* (2013.01); *H01R 27/00* (2013.01); *H01R 2107/00* (2013.01)

(58) Field of Classification Search
CPC ..... H01R 23/02; H01R 27/00; H01R 31/06
USPC ..... 439/218
See application file for complete search history.

(56) References Cited

U.S. PATENT DOCUMENTS

| | | | | |
|---|---|---|---|---|
| 8,784,123 | B1 * | 7/2014 | Leiba | H01R 27/00 439/218 |
| 2010/0267261 | A1 * | 10/2010 | Lin | H01R 13/6461 439/218 |
| 2010/0267262 | A1 * | 10/2010 | Lin | H01R 27/00 439/218 |
| 2011/0130019 | A1 * | 6/2011 | Lim | H01R 12/7047 439/218 |
| 2011/0312200 | A1 * | 12/2011 | Wang | H01R 12/724 439/218 |
| 2012/0252245 | A1 * | 10/2012 | Chang | H01R 13/6658 439/218 |
| 2015/0188252 | A1 * | 7/2015 | Yen | H01R 13/50 439/218 |
| 2015/0229077 | A1 * | 8/2015 | Little | H01R 13/6582 439/78 |

* cited by examiner

*Primary Examiner* — Chandrika Prasad
(74) *Attorney, Agent, or Firm* — Li & Cai Intellectual Property (USA) Office

(57) ABSTRACT

A double-sided USB connector structure includes an insulating body, a plurality of first terminals, a plurality of second terminals, a metal housing, and a spring mechanism. Said first terminals are disposed on the insulating body, several first contact portions are provided on the first terminals respectively, and the first contact portions are exposed on a first surface of the insulating body. Said second terminals are disposed on the insulating body, several second contact portions are provided on the second terminals respectively, and the second contact portions are exposed on a second surface of the insulating body. A containing space is provided within the metal housing, an opening is provided on one end of the metal housing, and the insulating body is floatingly suspended within the containing space through the spring mechanism.

15 Claims, 8 Drawing Sheets

DOUBLE-SIDED USB CONNECTOR STRUCTURE HAVING A SPRING MECHANISM SUPPORTING AN INSULATING BODY WITH PLURALITY OF TERMINALS ON TWO SURFACES OF THE INSULATING BODY

BACKGROUND OF THE INVENTION

1. Field of the Invention

The present disclosure relates to a USB connector structure; in particular, to a double-sided US connector structure.

2. Description of Related Art

Conventional USB connectors are connector devices used for electrically connecting cables, circuit boards and other circuit units, and are widely applied in electronic products such as cell phones, tablets, laptops, PDAs, etc. A conventional USB connector includes an insulating body and a plurality of terminals disposed on the insulating body. When coupling to another connector, the USB connector must be correctly oriented in order to achieve mating.

Hence, the present inventor believes the above mentioned disadvantages can be overcome, and through devoted research combined with application of theory, finally proposes the present disclosure which has a reasonable design and effectively improves upon the above mentioned disadvantages.

SUMMARY OF THE INVENTION

The object of the present disclosure is to provide a double-sided USB connector structure which can tightly couple to a corresponding connector in two orientations, making usage easier for the user.

In order to achieve the aforementioned objects, the present disclosure provides a double-sided USB connector, comprising: an insulating body having a first surface and a second surface, wherein one end of the insulating body is defined as a plugging end; a plurality of first terminals disposed on the insulating body and each formed with a first contact portion which are exposed on the first surface of the insulating body; a plurality of second terminals disposed on the insulating body and each formed with a second contact portion which is exposed on the second surface of the insulating body; a metal housing formed with a containing space therein and an opening at one end thereof, wherein the insulating body is disposed in the containing space and is free to be raised and lowered therein; and a spring mechanism supporting the insulating body in the metal housing.

The present disclosure has at least the following advantages. The insulating body of the present disclosure can be raised and lowered in the containing space of the metal housing. First terminals and second terminals are disposed on the insulating body. The first contact portions of the first terminals are exposed on the first surface of the insulating body, and the second contact portions of the second terminals are exposed on the second surface of the insulating body. The insulating body is supported by the spring mechanism in the metal housing. By these configurations, a double-sided connector structure is formed. Therefore the USB connector of the present disclosure can tightly couple to a corresponding connector in two orientations, making usage easier for the user.

In order to further the understanding regarding the present disclosure, the following embodiments are provided along with illustrations to facilitate the disclosure of the present disclosure.

DETAILED DESCRIPTION OF THE PREFERRED EMBODIMENTS

Figure 1:
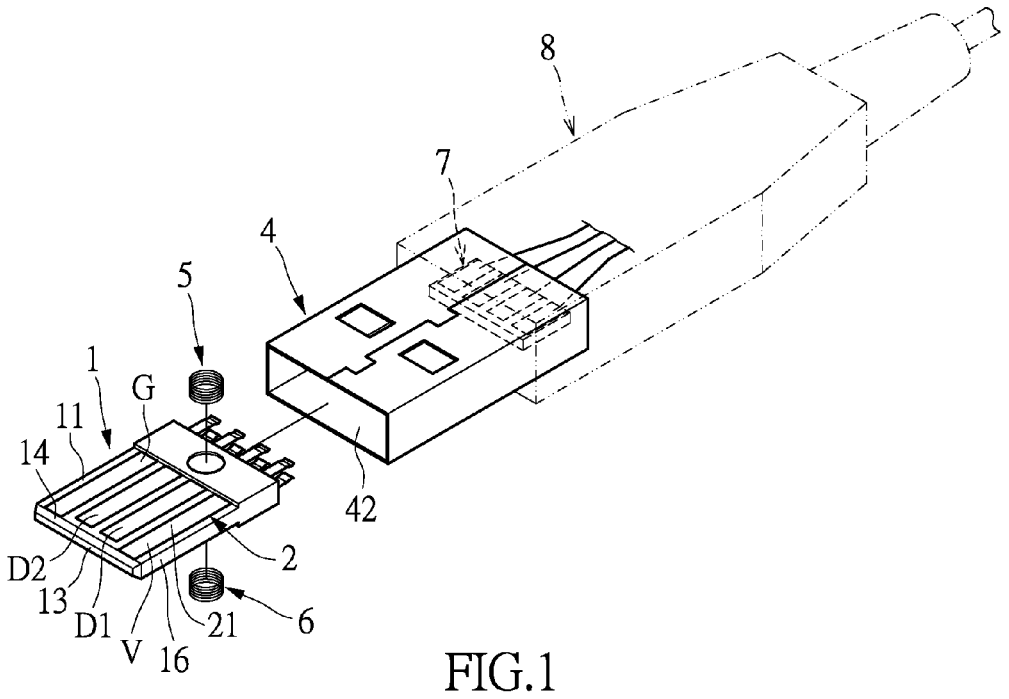
FIG. 1 shows a first exploded view of a connector structure according to a first embodiment of the present disclosure.
Figure 2:
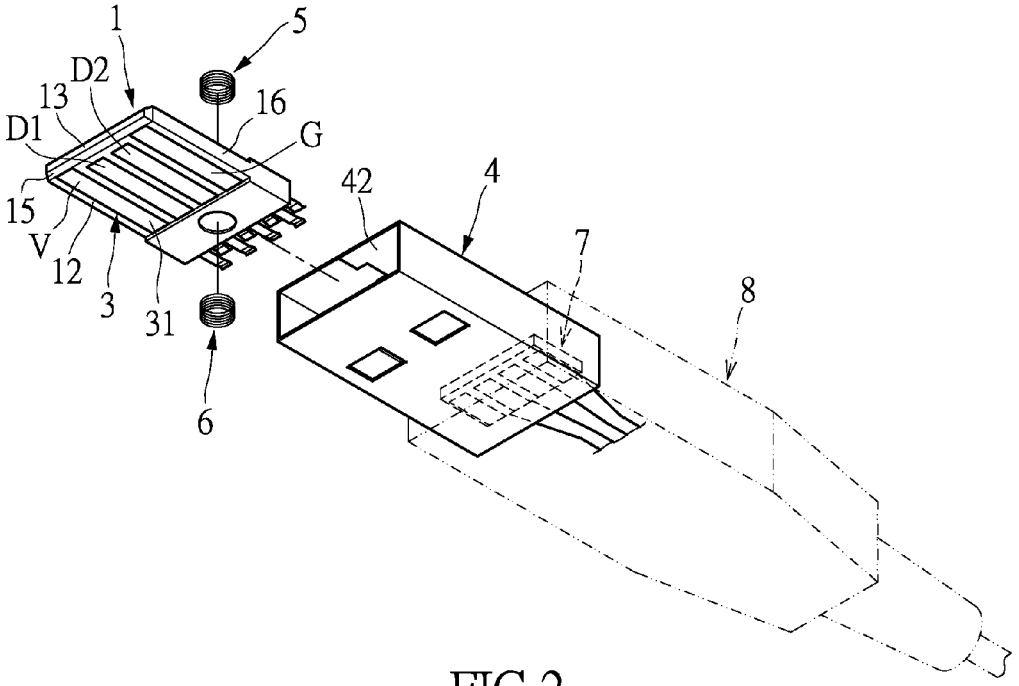
FIG. 2 shows a second exploded view of a connector structure according to a first embodiment of the present disclosure.
Figure 3:
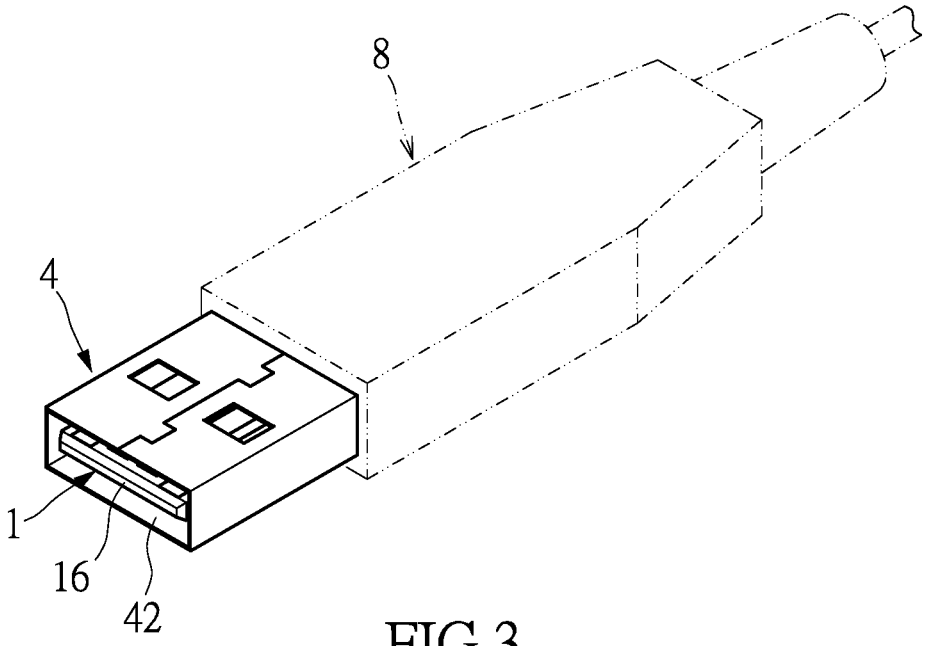
FIG. 3 shows a perspective view of an assembled connector structure according to a first embodiment of the present disclosure.

The aforementioned illustrations and following detailed descriptions are exemplary for the purpose of further explaining the scope of the present disclosure. Other objectives and advantages related to the present disclosure will be illustrated in the subsequent descriptions and appended drawings.

First Embodiment

Referring to FIG. 1 to FIG. 4, the present disclosure provides a double-sided USB connector structure, in particular to a USB connector structure which can couple to a corresponding connector in two orientations. The present embodiment discloses a type A male connector comprising an insulating body 1, a plurality of first terminals 2, a plurality of second terminals 3, a metal housing 4, a first spring unit 5 and a second spring unit 6.

Figure 4:
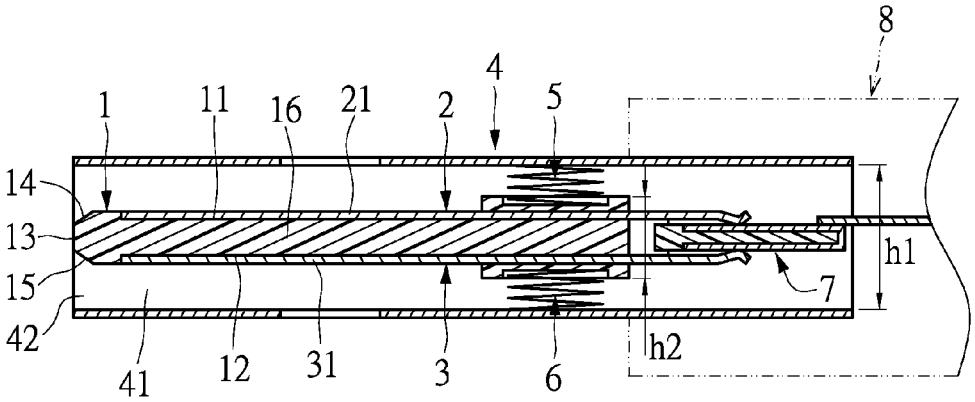
FIG. 4 shows a cross-sectional view of a connector structure according to a first embodiment of the present disclosure.

The insulating body 1 is made of plastic or other insulating material, and can be integrally formed as one body or assembled. The insulating body 1 has a first surface 11 and a second surface 12 on opposite sides thereof. As shown in FIG. 4, the first surface 11 is positioned at the top face of the insulating body 1, and the second surface 12 is positioned at the bottom face of the insulating body 1. One end of the insulating body 1 (front end) is defined as a plugging end 13. Guiding faces 14, 15 are formed respectively between the first surface 11 and the plugging end 13 and between the second surface 12 and the plugging end 13 for guiding the insulating body 1 to couple to a corresponding connector.

In the present embodiment, the insulating body 1 includes a tongue piece 16 positioned at the front portion of the insulating body 1 and neighboring the plugging end 13. The first surface 11 and the second surface 12 extend to the tongue piece 16. The tongue piece 16 of the insulating body 1 is configured to be plugged into a corresponding connector. However, the shape and structure of the insulating body 1 is not limited and can be altered according to need.

The first terminals 2 and the second terminals 3 are made of metals having good electrical conductivity, or alloys thereof, and are disposed on the insulating body 1. The method of arranging the first terminals 2 and the second terminals 3 on the insulating body 1 is not limited. In the present embodiment, the first terminals 2 and the second terminals 3 are disposed onto the first insulating body 1 by insert molding. The shape and structure of the first terminals 2 and the second terminals 3 are not limited and can be altered according to need. The first terminals 2 and the second terminals 3 can include power supply terminals V, first and second signal terminals D1, D2 and ground terminals G, etc.

The first terminals 2 are each formed with a first contact portion exposed on the first surface 11 of the insulating body 1 for contacting and electrically connecting to terminals on a corresponding connector. The second terminals 3 are each formed with a second contact portion 31 exposed on the second surface 12 of the insulating body 1 for contacting and electrically to terminals on a corresponding connector. The first contact portions 21 and the second contact portions 31 are arranged on two sides of the insulating body 1, thereby forming a double-sided connector structure.

An end (the rear end) of each of the first terminals 2 and the second terminals 3 can be electrically connected to a cable, etc. In the present embodiment, a circuit unit 7 is disposed on the insulating body 1 or behind the insulating body 1. The first terminals 2 and the second terminals 3 are electrically connected to the circuit unit 7 which serves as a jumper connection, thereby forming a double-sided connector structure. The first terminals 2 and the second terminals 3 can also be connected by multilayer circuit wiring or other methods. In another embodiment, the insulating body 1 can also be formed with a circuit board, and the first terminals 2 and the second terminals 3 are formed on the circuit board.

The metal housing 4 is arranged outside the insulating body 1. Namely, the metal housing 4 is formed with a containing space 41 therein, one end of the metal housing 4 is formed with an opening 42, and the containing space 41 is in fluid communication with the exterior through the opening 42. The insulating body 1 is disposed in the containing space 41. A height h1 of the containing space 41 is greater than a height h2 of the insulating body 1, such that the insulating body 1 can be raised and lowered in the containing space 41 for adjusting the position of the insulating body according to an orientation of mating. The rear portion of the metal housing 4 can be covered by an outer housing 8.

In the present embodiment, the quantities of disposed first spring unit 5 and second spring unit 6 are one each. However, the quantities of the first spring unit 5 and the second spring unit 6 are not limited. The first spring unit 5 and the second spring unit 6 can be coil springs, spring plates, or elastic units like rubber. The first spring unit 5 is disposed between the first surface 11 of the insulating body 1 and the metal housing 4. The second spring unit 6 is disposed between the second surface 12 of the insulating body 1 and the metal housing 4. Preferably, one end of the first spring unit 5 and one end of the second spring unit 6 are attached to the insulating body 1. Another end of the spring unit 5 and another end of the spring unit 6 are attached to the metal housing 4. The first spring unit 5 and the second spring unit 6 form a spring mechanism for suspendingly supporting the insulating body 1 in the containing space 41.

The insulating body 1 of the present disclosure can be raised and lowered in the containing space 41 of the metal housing 4. The first terminals 2 and the second terminals 3 are disposed on the insulating body 1. The first contact portions 21 of the first terminals 2 are exposed on the first surface 11 of the insulating body 1. The second contact portions 31 of the second terminals 3 are exposed on the second surface 12 of the insulating body 1. The insulating body 1 is supported by the spring mechanism in the metal housing. By these configurations, a double-sided connector structure is formed. The insulating body 1 is disposed in the containing space 41 and is free to be raised and lowered therein, for adjusting the up and down position of the insulating body 1 to adapt to mating in two orientations.

Figure 5:
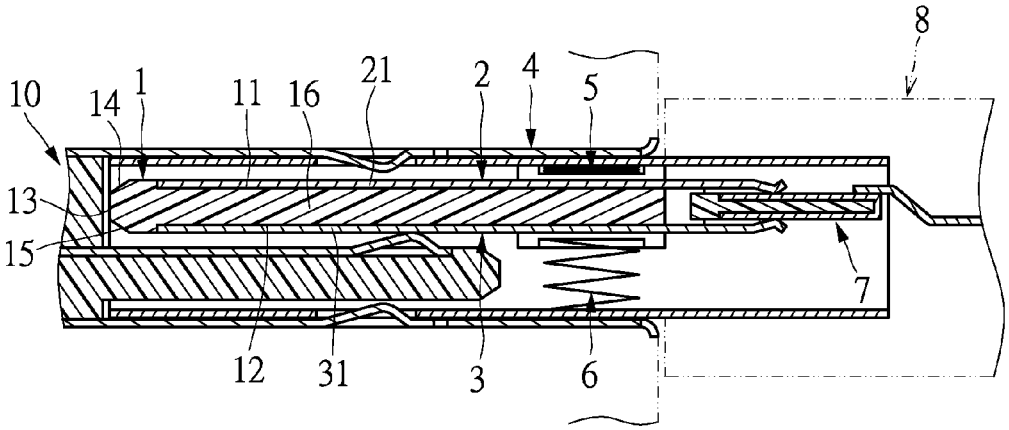
FIG. 5 shows a cross-sectional view of a connector structure under one state of operation according to a first embodiment of the present disclosure.
Figure 6:
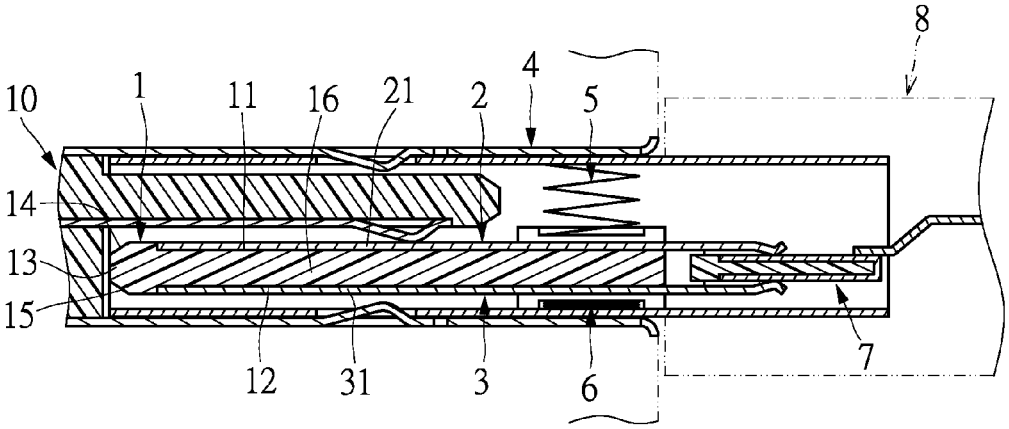
FIG. 6 shows a cross-sectional view of a connector structure under another state of operation according to a first embodiment of the present disclosure.

Therefore the connector of the present disclosure can couple to a corresponding connector 10 in two orientations (as shown in FIG. 5 and FIG. 6). As shown in FIG. 5, the insulating body 1 of the present disclosure can be pushed upward by the corresponding connector 10 to a first position, wherein the second contact portions 31 of the second terminals 3 contact the terminals of the corresponding connector 10 for achieving electrical connection. As shown in FIG. 6, the insulating body 1 of the present disclosure can also be pushed downward by the corresponding connector 10 to a second position, wherein the first contact portions 21 of the first terminals 2 contact the terminals of the corresponding connector 10 for achieving electrical connection. The connector of the present disclosure can couple to the corresponding connector 10 right-side-up or upside-down, making usage easier for the user. The freedom of the insulating body 1 to move in the containing space 41 of the metal housing 4 allows a tight mating between the connector of the present disclosure and the corresponding connector 10.

Second Embodiment

Figure 7:
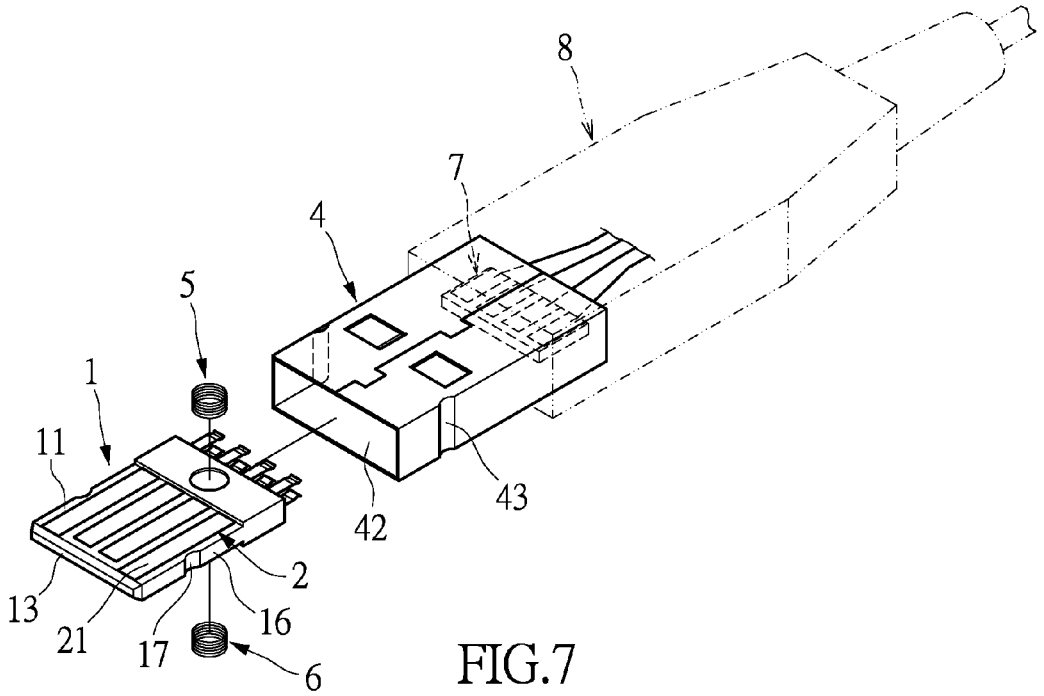
FIG. 7 shows an exploded view of a connector structure according to a second embodiment of the present disclosure.

Referring to FIG. 7, the insulating body 1 is free to be raised and lowered in the containing space 41 of the metal housing 4. To stabilize the raising and lowering of the insulating body 1, a guiding structure can be disposed between the insulating body 1 and the metal housing 4, e.g. installing a first sliding portion 17 (such as a sliding groove) at two sides of the insulating body 1 and a second sliding portion 43 (such as a sliding rail) at two sides of the metal housing 4. The second sliding portions 43 extend vertically. The two first sliding portions 17 engage the two second sliding portions 43, thereby guiding the insulating body 1 to stably move up and down. However, the form of the guiding structure is not limited. For example, the sliding groove and the sliding rail of the first sliding portions 17 and the second sliding portions 43 can be interchanged, or replaced by guiding columns and guiding holes, etc.

Third Embodiment

Figure 8:
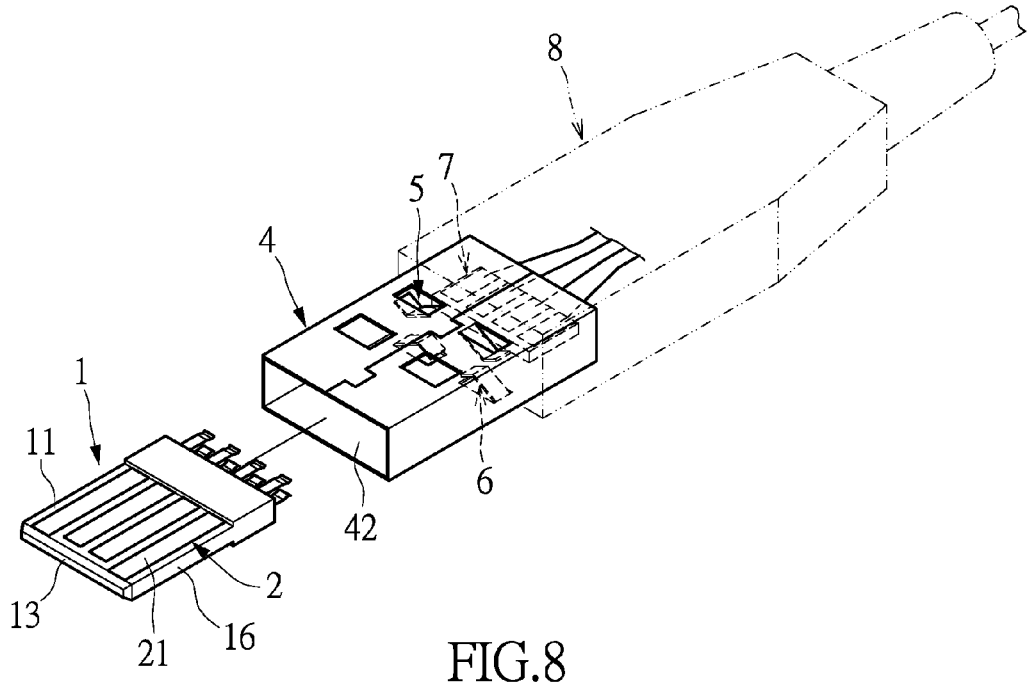
FIG. 8 shows an exploded view of a connector structure according to a third embodiment of the present disclosure.

Referring to FIG. 8, the spring mechanism of the present disclosure can be integrally formed as one body with the metal housing 4. Namely, the first spring unit 5, the second spring unit 6, and the metal housing 4 can be integrally formed as one body. The present embodiment includes two first spring units 5 and two second spring units 6. Specifically, the first spring units 5 are integrally formed as one body with the top portion of the metal housing 4, and the second spring units 6 are integrally formed as one body with the bottom portion of the metal housing 4, such that the first spring units 5 are arranged between the first surface 11 of the insulating body 1 and the metal housing, and the second spring units 6 are arranged between the second surface 12 of the insulating body 1 and the metal housing 4. The insulating body 1 is suspendingly supported by the spring mechanism in the containing space 41.

Fourth Embodiment

Figure 9:
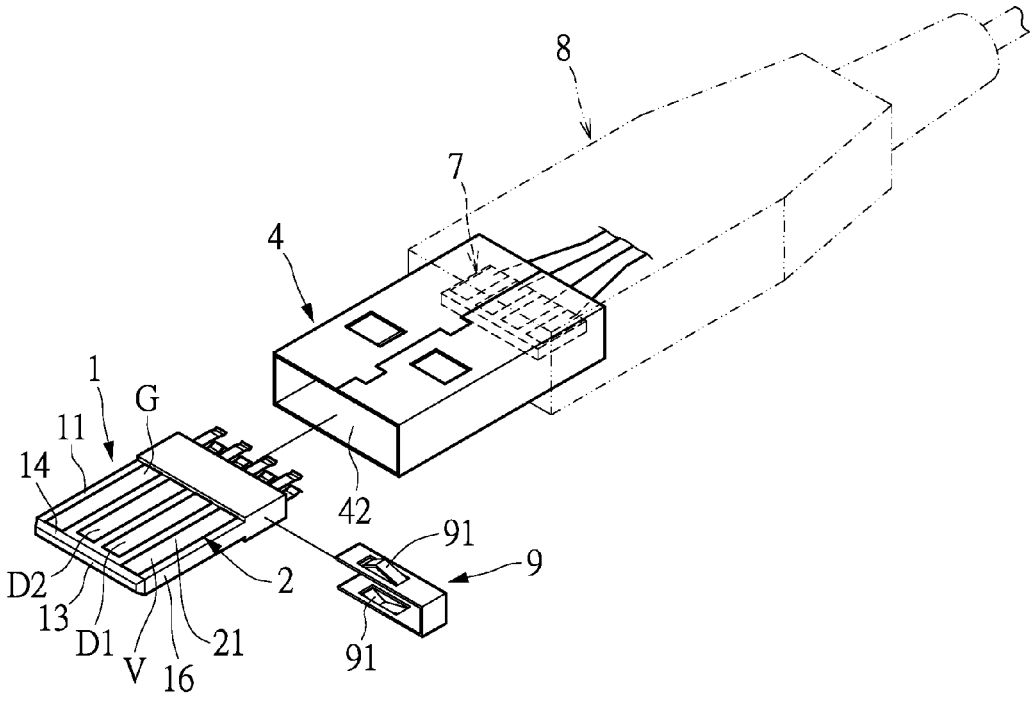
FIG. 9 shows an exploded view of a connector structure according to a fourth embodiment of the present disclosure.

Referring to FIG. 9, the spring mechanism of the present disclosure has another form. Namely, a spring body 9 can be disposed between the insulating body 1 and the housing 4. The spring body 9 is U-shaped, and can clamp the insulating body 1. The top portion and the bottom portion of the spring body 9 each have an elastic plate 91. The two elastic plates 91 respectively abut the top portion and the bottom portion of the metal housing, such that the insulating body 1 can be suspendingly supported by the spring mechanism in the containing space 41

Fifth Embodiment

Figure 10:
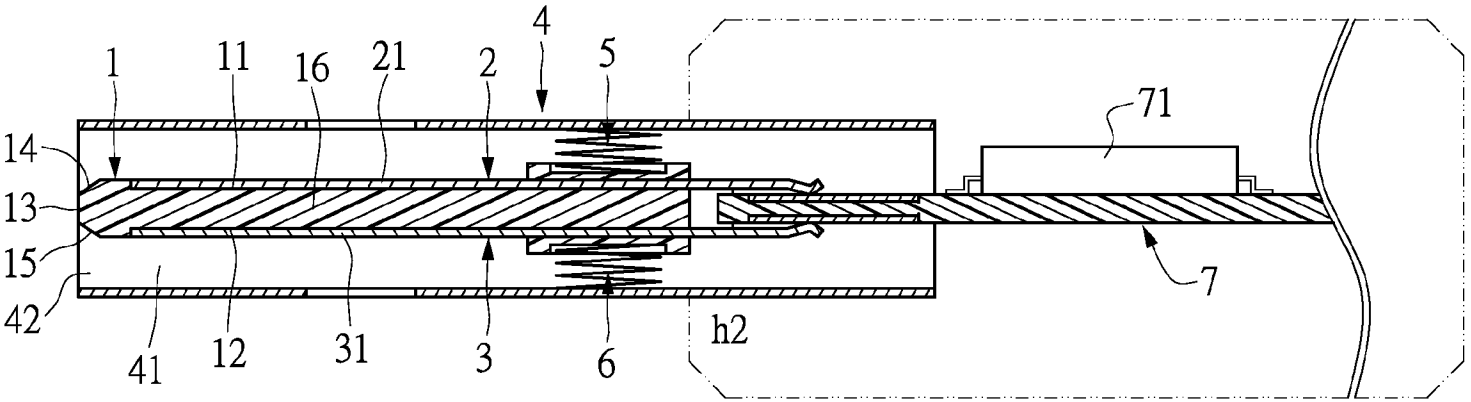
FIG. 10 shows a cross-sectional view of a connector structure according to a fifth embodiment of the present disclosure.

Referring to FIG. 10, the circuit unit 7 of the present embodiment includes a memory unit 71, such that the connector of the present embodiment can form a storage device (such as a flash drive).

Sixth Embodiment

Figure 11:
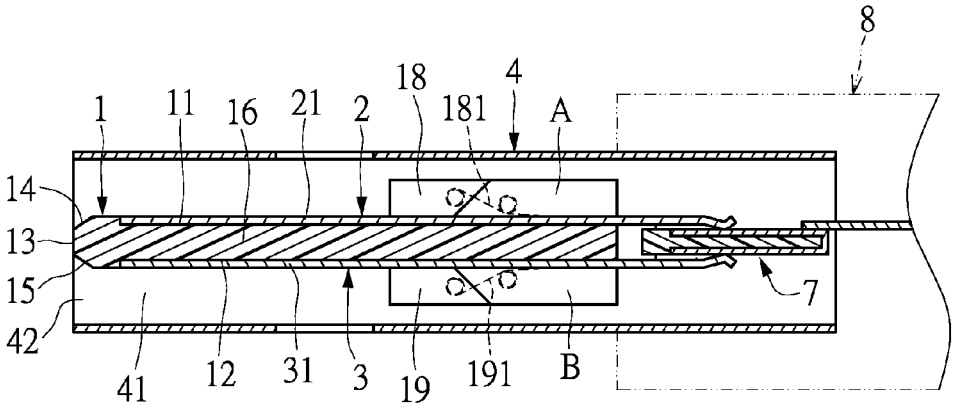
FIG. 11 shows a cross-sectional view of a connector structure according to a sixth embodiment of the present disclosure.

Referring to FIG. 11, a first sliding block 18 and a second sliding block 19 can be disposed in the metal housing 4. The first sliding block 18 is disposed between the first surface 11 of the insulating body 1 and the metal housing 4. The second sliding block 19 is disposed between the second surface 12 of the insulating body 1 and the metal housing 4. The first sliding block 18 and the second sliding block 19 can move along a plugging direction of the connector (forward and backward). The first sliding block 18 and the second sliding block 19 can respectively be connected with elastic bodies 181 and 191 for restoring purposes. The elastic bodies 181 and 191 can be coil springs, spring plates or elastic units like rubber, etc. The elastic bodies 181 and 191 can be disposed between the first sliding block 18, the second sliding block 19 and the metal housing 4 or the insulating body 1. The elastic bodies 181 and 191 can push the first sliding block 18 and the second sliding block 19 forward for restoring original positions. The rear portion of the insulating body 1 is formed with a first protrusion A and a second protrusion B. The first protrusion A is joined to an end of the first surface 11 distal from the plugging end 13, and protrudes from the first surface 11. The first sliding block 18 selectively slides to the first protrusion A. The second protrusion B is joined to an end of the second surface 12 distal from the plugging end 13, and protrudes from the second surface 12. The second sliding block 19 selectively slides to the second protrusion B.

Figure 12:
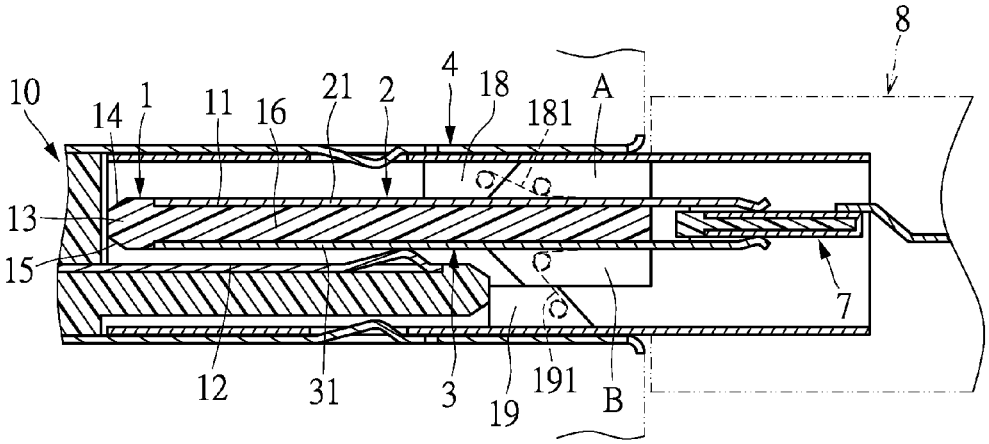
FIG. 12 shows a cross-sectional view of a connector structure under one state of operation according to a sixth embodiment of the present disclosure.

As shown in FIG. 12, the insulating body 1 of the present disclosure can be pushed upward by the corresponding connector 10 to a first position, wherein the second contact portions 31 of the second terminals 3 contact and electrically connect terminals of the corresponding connector 10, and the corresponding connector 10 pushes the second sliding block 19 backward such that the second sliding block 19 slides along the second surface 12 to the second protrusion B and then slides in between the second protrusion B and the bottom portion of the metal housing 4, such that the insulating body 1 can be securely positioned in the metal housing 4 for tight mating with the corresponding connector 10.

Figure 13:
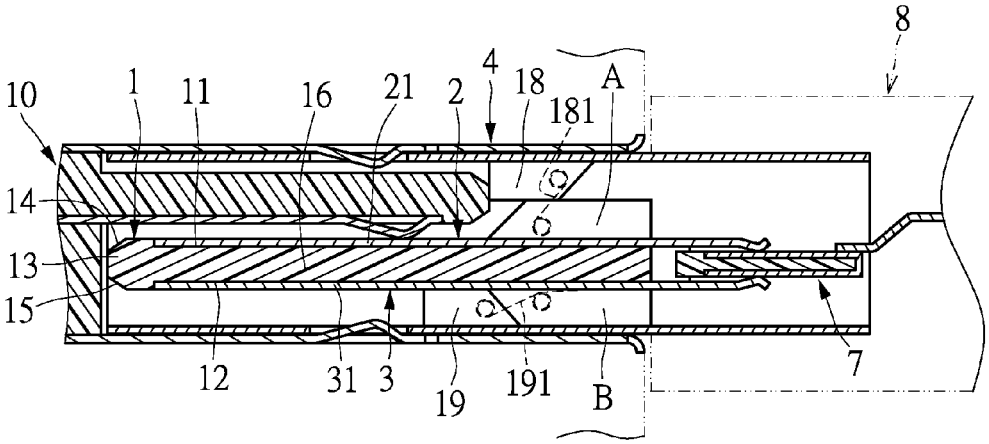
FIG. 13 shows a cross-sectional view of a connector structure under another state of operation according to a sixth embodiment of the present disclosure.

As shown in FIG. 13, the insulating body 1 of the present disclosure can be pushed downward by the corresponding connector 10 to a second position, wherein the first contact portions 21 of the first terminals 2 contact and electrically connect terminals of the corresponding connector 10, and the corresponding connector 10 pushes the first sliding block 18 backward such that the first sliding block 18 slides along the first surface 11 to the first protrusion A and then slides in between the first protrusion A and the top portion of the metal housing 4, such that the insulating body 1 can be securely positioned in the metal housing 4 for tight mating with the corresponding connector 10.

Seventh Embodiment

Figure 14:
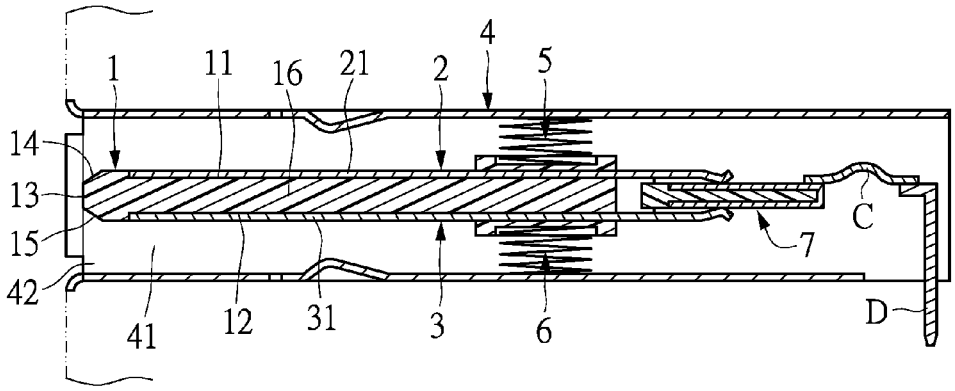
FIG. 14 shows a cross-sectional view of a connector structure according to a seventh embodiment of the present disclosure.

Referring to FIG. 14, the USB connector structure of the present embodiment is a type A female connector, comprising an insulating body 1, a plurality of first terminals 2, a plurality of second terminals 3, a metal housing 4 and a spring mechanism (including a first spring unit 5 and a second spring unit 6). The insulating body 1 has a first surface 11 and a second surface 12. One end of the insulating body 1 is defined as a plugging end 13. The first terminals 2 are disposed on the insulating body 1 and are each formed with a first contact portion 21 exposed on a first surface 11 of the insulating body 1. The second terminals 3 are disposed on the insulating body 1 and are each formed with a second contact portion 31 exposed on a second surface 12 of the insulating body 1. The metal housing 4 is formed with a containing space 41 therein. One end of the metal housing 4 is formed with an opening 42. The insulating body 1 is free to be raised and lowered in the containing space 41. The insulating body 1 is supported by the spring mechanism in the metal housing 4. The first terminals 2 and the second terminals 3 are electrically connected to a circuit unit 7. The circuit unit 7 is electrically connected to a plurality of flexible wiring C and a plurality of pins D. The pins D can be electrically connected to circuit boards, etc. The USB connector structure of the present embodiment can couple to a corresponding connector right-side-up or upside-down, making usage easier for the user and achieving a tight mating between the connector of the present embodiment and the corresponding connector.

Eighth Embodiment

Figure 15:
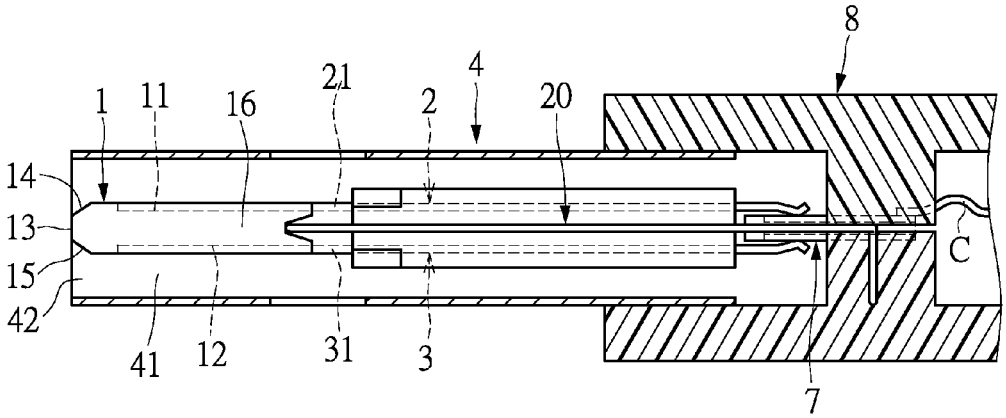
FIG. 15 shows a cross-sectional view of a connector structure according to an eighth embodiment of the present disclosure.

Referring to FIG. 15, the insulating body 1 is supported at the metal housing by a spring mechanism. The spring mechanism includes an elastic unit 20, which can be a spring coil, spring plate, rubber or other elastic objects. The elastic unit 20 is disposed in the metal housing 4 and between the insulating body 1 and the outer housing 8. The elastic unit 20 abuts the insulating body 1, such that the insulating body 1 is suspendingly supported in the containing space 41 by the spring mechanism.

The descriptions illustrated supra set forth simply the preferred embodiments of the present disclosure; however, the characteristics of the present disclosure are by no means restricted thereto. All changes, alterations, or modifications conveniently considered by those skilled in the art are deemed to be encompassed within the scope of the present disclosure delineated by the following claims.

What is claimed is:

1. A double-sided USB connector structure, comprising:

an insulating body having a first surface and a second surface, wherein one end of the insulating body is defined as a plugging end;

a plurality of first terminals disposed on the insulating body and each formed with a first contact portion exposed on the first surface of the insulating body;

a plurality of second terminals disposed on the insulating body and each formed with a second contact portion exposed on the second surface of the insulating body;

a metal housing formed with a containing space therein, wherein one end of the metal housing is formed with an opening, and the insulating body is disposed in the containing space and is free to be raised and lowered in the containing space; and a spring mechanism, supporting the insulating body in the metal housing.

2. The double-sided USB connector structure according to claim 1, wherein guiding faces are respectively formed between the plugging end and the first surface and between the plugging end and the second surface.

3. The double-sided USB connector structure according to claim 1, wherein the insulating body includes a tongue piece positioned at a front portion of the insulating body and neighboring the plugging end, and the first surface and the second surface extend to the tongue piece.

4. The double-sided USB connector structure according to claim 1, wherein a circuit unit is disposed on the insulating body or behind the insulating body, and the first terminals and the second terminals are electrically connected to the circuit unit.

5. The double-sided USB connector structure according to claim 1, wherein the spring mechanism includes a first spring unit and a second spring unit, the first spring unit is disposed between the first surface of the insulating body and the metal housing, and the second spring unit is disposed between the second surface of the insulating body and the metal housing.

6. The double-sided USB connector structure according to claim 5, wherein one end of the first spring unit and one end of the second spring unit are attached to the insulating body, and another end of the first spring unit and another end of the second spring unit are attached to the metal housing.

7. The double-sided USB connector structure according to claim 5, wherein the first spring unit, the second spring unit, and the metal housing are integrally formed as one body.

8. The double-sided USB connector structure according to claim 1, wherein the spring mechanism includes a spring body clamping the insulating body, a top portion and a bottom portion of the spring body each have an elastic plate respectively abutting a top portion of the metal housing and a bottom portion of the metal housing.

9. The double-sided USB connector structure according to claim 1, wherein a guiding structure is disposed between the insulating body and the metal housing.

10. The double sided USB connector structure according to claim 9, wherein two sides of the insulating body are each formed with a first sliding portion, two sides of the metal housing are each formed with a second sliding portion, the second sliding portions extend vertically, and the two first sliding portions engage the two second sliding portions, forming the guiding structure.

11. The double-sided USB connector structure according to claim 1, wherein the insulating body is a circuit board.

12. The double-sided USB connector structure according to claim 1, wherein a first sliding block and a second sliding block are disposed in the metal housing, the first sliding block is disposed between the first surface of the insulating body and the metal housing, the second sliding block is disposed between the second surface of the insulating body and the metal housing, the first sliding block and the second sliding block are configured to move along a plugging direction, the insulating body is formed with a first protrusion and a second protrusion, the first protrusion is joined to an end of the first surface distal from the plugging end, the second protrusion is joined on an end of the second surface distal from the plugging end, the first sliding block selectively slides toward the first protrusion and then slides in between the first protrusion and the metal housing, and the second sliding block selectively slides toward the second protrusion and then slides in between the second protrusion and the metal housing.

13. The double-sided USB connector structure according to claim 12, wherein the first sliding block and the second sliding block are each connected to an elastic body for restoring the positions of the first sliding block and the second sliding block.

14. The double-sided USB connector structure according to claim 1, wherein the USB connector structure is a type A male connector or a type A female connector.

15. The double-sided USB connector structure according to claim 1, wherein the spring mechanism includes an elastic unit, the elastic unit is disposed between the insulating body and an outer housing, the elastic unit abuts the insulating body for suspendingly supporting the insulating body in the containing space.

* * * * *